United States Patent [19]

Eley

[11] 4,147,999

[45] Apr. 3, 1979

[54] CIRCUIT BREAKER

[75] Inventor: Edgar R. Eley, Athens, Ga.

[73] Assignee: Westinghouse Electric Corp., Pittsburgh, Pa.

[21] Appl. No.: 861,581

[22] Filed: Dec. 19, 1977

[51] Int. Cl.[2] ..... H01H 75/12

[52] U.S. Cl. ..... 335/35; 335/37; 337/78

[58] Field of Search ..... 335/35, 36, 37, 6, 45; 337/75, 78

[56] References Cited

U.S. PATENT DOCUMENTS

| | | | |
|---|---|---|---|
| 3,353,128 | 11/1967 | Gauthier | 335/35 |
| 3,840,833 | 10/1974 | Menna et al. | 335/35 X |
| 3,997,857 | 12/1976 | Wien et al. | 335/35 |

*Primary Examiner*—George Harris
*Attorney, Agent, or Firm*—D. R. Lackey

[57] ABSTRACT

A circuit breaker having a magnetic trip mechanism pivotally mounted on the bimetal actuating assembly. First and second flanges extend from the bimetal element and respectively include first and second co-axially aligned apertures. A magnetic trip arm is pivotally mounted in the first and second apertures and includes a first portion disposed in proximity to the bimetal element to be drawn thereto in response to a high overload current flowing therethrough and a second portion which engages a latch, upon movement of the magnetic trip arm, thereby tripping open the contacts of the circuit breaker.

7 Claims, 6 Drawing Figures

FIG. 5
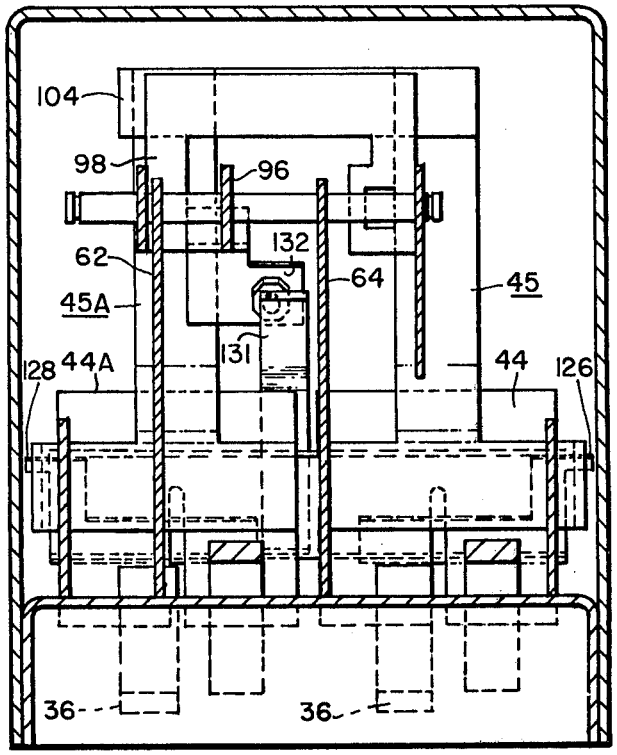
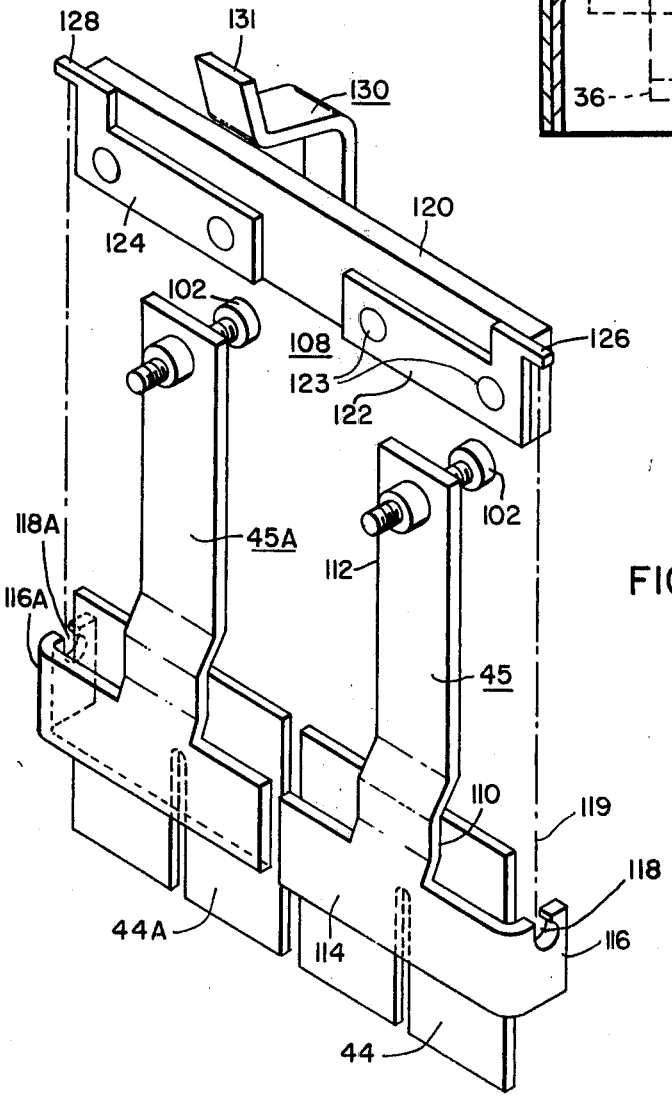
FIG. 6

CIRCUIT BREAKER

BACKGROUND OF THE INVENTION

1. Field of the Invention

This invention relates to circuit interrupters of the type having a bimetallic thermal trip element and a magnetic instantaneous element and, more specifically, to circuit breakers for distribution transformers to control moderate power distribution on feeder circuits.

2. Description of the Prior Art

Transformers used in power distribution systems generally include a protective device which prevents or limits current overload damage to the transformer and its associated apparatus. A completely self-protected transformer includes a circuit interrupter on the secondary or low voltage side to protect against damage due to overload currents. The secondary circuit interrupter disconnects the transformer from its load if the load current becomes dangerously high.

Commonly used circuit interrupters often incorporate a bimetal thermal trip and an instantaneous magnetic trip. Conventional magnetic trip mechanisms are pivotably mounted in order to provide instantaneous action as seen in U.S. Pat. Nos. 3,983,454; 3,860,898; 3,548,358; 3,288,965; and 3,178,535, wherein the armature or magnetic trip arm is pivotally mounted on the casing of the circuit breaker. These magnetic trip elements include a first portion disposed in proximity with the bimetal element so as to be drawn thereto when a high overload current flows through the bimetal element and a second portion which engages a latch mechanism, upon movement of the trip arm, thereby releasing the latch and opening the contacts of the circuit breaker. In U.S. Pat. No. 3,997,857, assigned to the assignee of the present application, the trip arm is integrally secured to the latch mechanism which thereby forms its pivot point.

SUMMARY OF THE INVENTION

There is disclosed herein a circuit interrupter for use as a circuit breaker in a distribution transformer which includes a novel magnetic trip mechanism. The bimetal actuating assembly is formed to become a part of the magnetic trip mechanism. An extension member is joined to and is deflectable with the bimetal element and includes a first end portion which engages the latch mechanism upon deflection of the bimetal element. The extension member further includes a second end portion, disposed adjacent one side of the bimetal element, which has first and second flanges extending beyond the other side of the bimetal element. First and second apertures are disposed in the first and second flanges, respectively, and are coaxially aligned along a first axis to form hinge points wherein a magnetic trip arm is pivotally mounted. The magnetic trip arm includes a first radially extending portion formed of a magnetic material which is disposed in proximity to the bimetal element so as to be drawn thereto when a high overload current flows through the bimetal element. Upon movement of the first portion of the magnetic trip arm towards the bimetal element, a second radially extending end portion of the magnetic trip arm engages and rotates a trip bar attached to the latch mechanism, thereby releasing the latch which opens the contacts of the circuit breaker.

In multiple pole circuit breakers, each pole is provided with an individual bimetal element and extension member which deflect thereby releasing the latch and tripping open the contacts of the circuit breaker when current above a preselected level flows through one of the bimetal elements for a certain period of time. The outermost extension members in the multiple pole configuration have a flange portion extending beyond the bimetal element with an aperture therein which forms one end of a hinge whereon the magnetic trip arm is disposed. The first portion of the magnetic trip arm may be one continuous piece which is pivotally mounted in proximity with all of the aligned bimetal elements to thereby instantaneously trip the latch mechanism when a high overload current flows through any of the bimetal elements.

BRIEF DESCRIPTION OF THE DRAWINGS

The various features, advantages and additional uses of this invention will become more apparent by referring to the following detailed description and the accompanying drawings, in which:

FIG. 5 is a sectional view, generally taken along line V—V in FIG. 4; and

FIG. 6 is an exploded, perspective view of a portion of the circuit breaker shown in FIG. 2 which clearly shows the bimetal and magnetic trip mechanisms.

DESCRIPTION OF THE PREFERRED EMBODIMENTS

Figure 1:
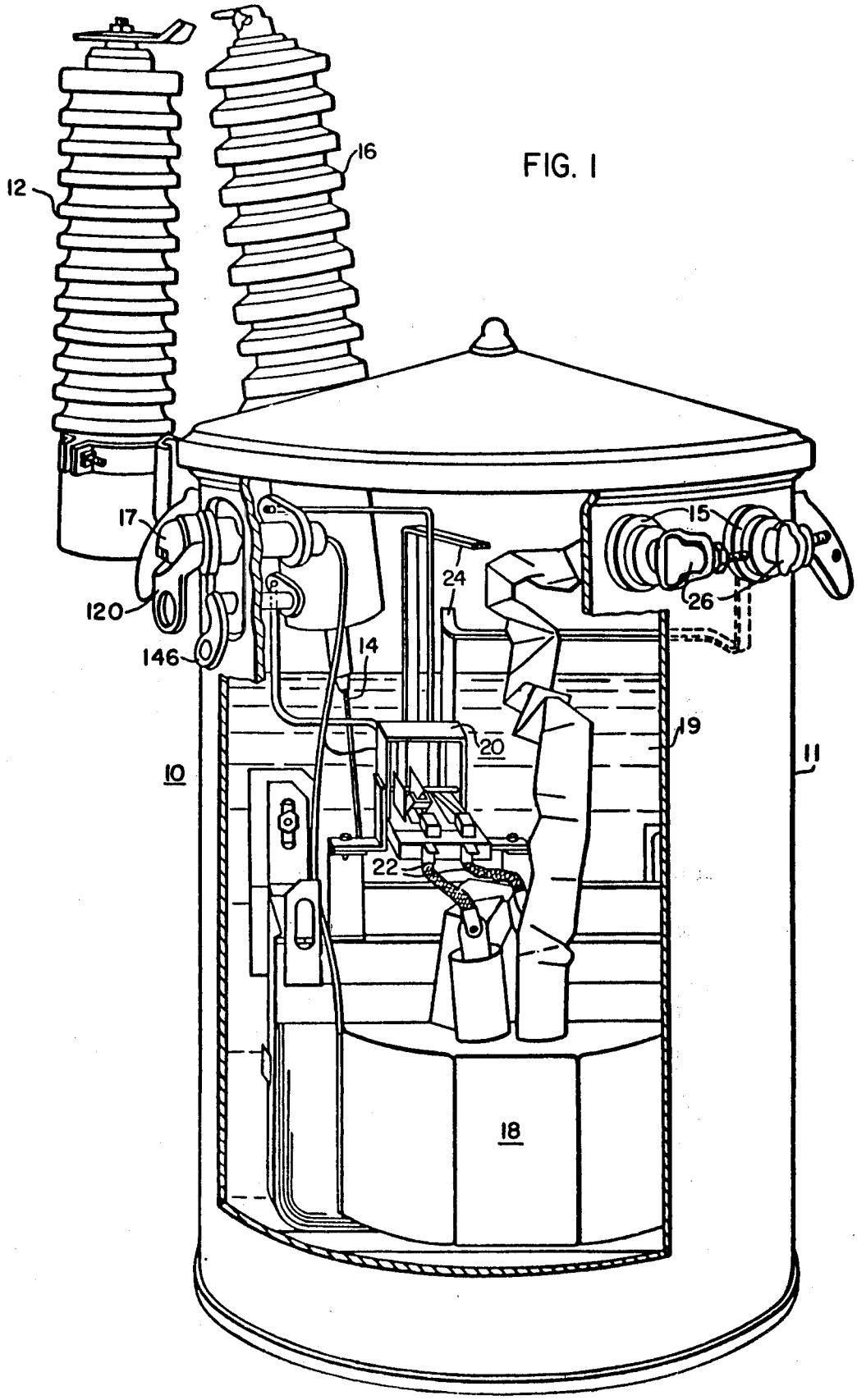
FIG. 1 is a perspective view of an oil-filled distribution transformer utilizing the teachings of this invention.
Figure 2:
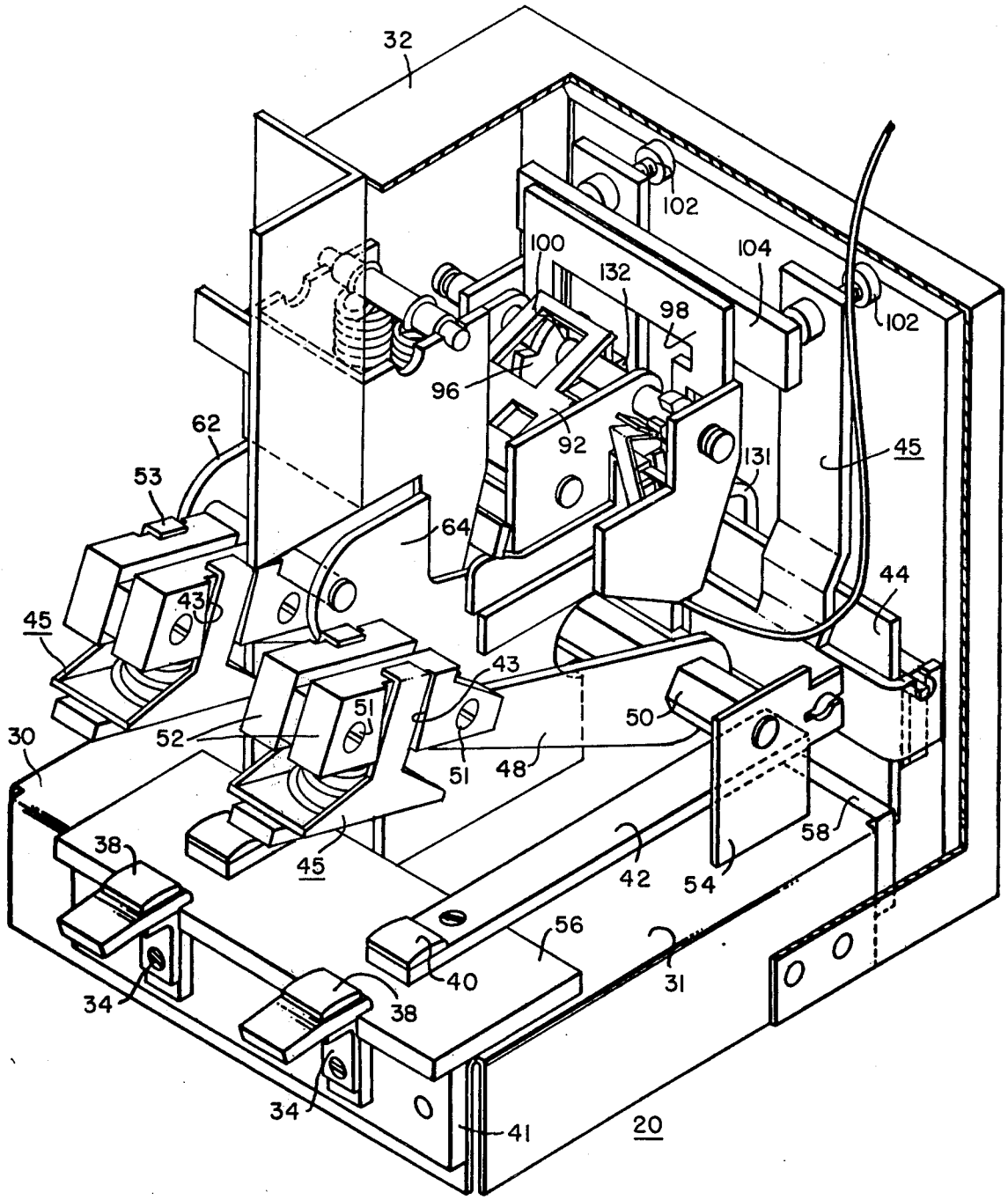
FIG. 2 is a perspective view of a secondary circuit breaker for use on the distribution transformer.
Figure 4:
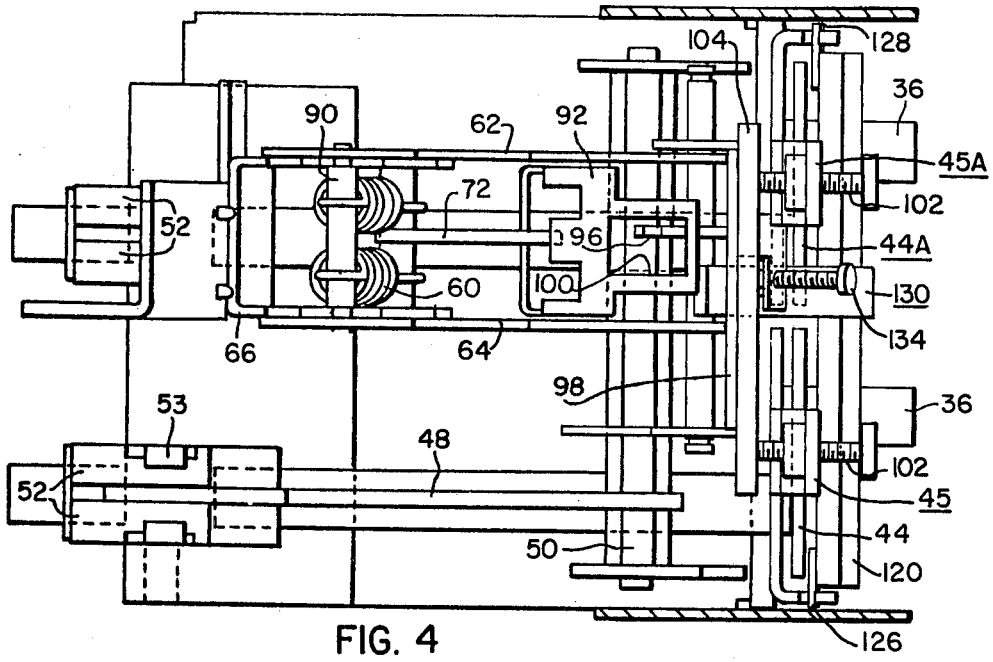
FIG. 4 is a side view of the circuit breaker shown in FIG. 3 with portions broken away for clarity.
Figure 3:
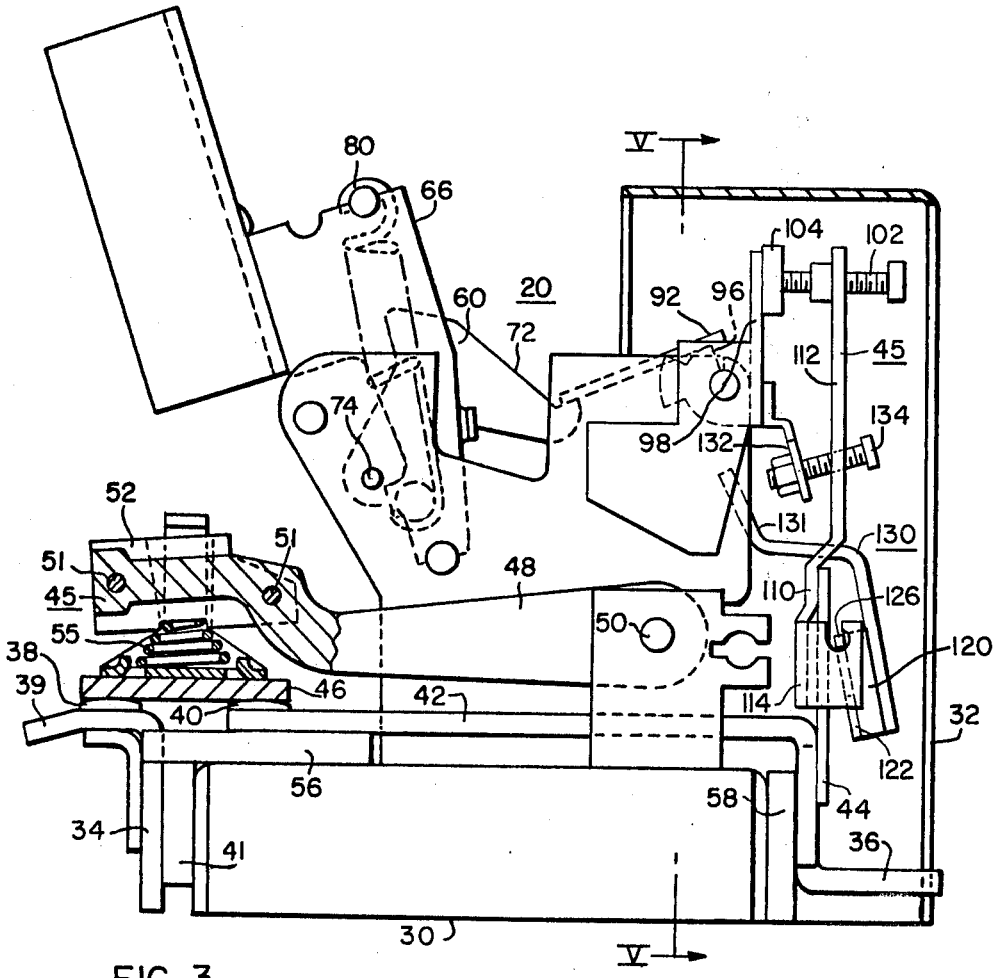
FIG. 3 is a top view of the circuit breaker shown in FIG. 2 with the contacts in the closed position.

Throughout the following description, identical reference numbers refer to the same component shown in all figures of the drawing.

Referring now to the drawings, and FIG. 1 in particular, there is shown a pole type completely self-protected distribution transformer 10 including a circuit breaker 20 utilizing the teaching of the present invention. The transformer 10 includes an enclosure or tank 11 with a lightning arrestor 12 and a primary high voltage bushing 16 mounted thereon. Secondary bushings, such as the low voltage bushings 15, to which the transformer load is connected, are attached to the enclosure 11. A signal light 17 is mounted on the enclosure 11 and is electrically connected to the circuit breaker 20 to be actuated at a predetermined low overload. The core and coil assembly 18 is secured inside the enclosure 11 with the circuit breaker 20 attached thereto. Required primary winding leads 14 extend from the core and coil assembly 18 to the appropriate high voltage bushings 16. The housing 11 is partially filled with an insulating liquid dielectric 19, such as transformer oil. The circuit breaker 20 and the core and coil assembly 18 are immersed in the insulating oil 19. Secondary connections 22, coming from the core and coil assembly 18, connect to input terminals on circuit breaker 20. Conductors 24 connect the output terminals of circuit breaker 20 to the low voltage bushings 15 mounted on the transformer tank 11. Appropriate loads can then be connected to the low voltage terminals 26 of the distribution transformer 10.

Referring now to FIGS. 2 through 5, there are shown embodiments of a two-pole circuit breaker 20 utilizing the teachings of the present invention. The circuit interrupter 20 is mounted on a metallic base 30. A cover 32 is provided partially surrounding the sensing and tripping elements of the circuit breaker 20 to provide protection during handling. Secondary leads 22 of the core and coil assembly 18 are attached to incoming circuit breaker terminals 34. Electrical conductors 24, disposed between the circuit breaker 20 and the low voltage transformer bushings 15, attach to circuit breaker 20 at terminals 36. Circuit breaker terminals 34 connect to stationary contacts 38. Circuit breaker terminals 36 connect to stationary contact 40 through electrical conductor 42 and bimetal 44. Stationary contacts 38 and 40 of each pole are disposed in a spaced apart relationship. A bridging contact 46 is provided which, with the circuit breaker in the closed position, completes an electrical connection between stationary contacts 38 and 40. Thus, with the circuit interrupter 20 closed an electric circuit is completed from a terminal 34 through stationary contact 38, bridging contact 46, stationary contact 40, electrical conductor 42, and bimetal 44 to circuit breaker terminal 36. The bridging contact assembly 45 includes the movable bridging contact 46 attached to one portion thereof which, when the circuit interrupter is closed, completes an electrical connection between stationary contacts 38 and 40. Although the contact structure described above includes two stationary and one movable contacts, other contact arrangements involving separable contacts, such as those having one stationary and one moving contact, or two movable contacts, may be utilized as well.

In the disclosed distribution transformer, the bridging contact 46 is located below the bimetal 44. This is a most desirable feature since if for any reason a transformer should develop an oil leak the bimetal will be first to be exposed above the oil in the gas space and will heat up rapidly causing the breaker to trip while the contacts 46, 38 and 40 are still under the oil. This sequence of operation is desirable since it prevents contact arcing in the volatile gas space above the reduced oil level.

Each pole of the circuit breaker 20 is provided with an elongated contact arm 48 which, at one end, is rigidly secured to a through shaft 50. Shaft 50, which can be a metallic member, connects together the elongated contact arms 48 of all poles of the circuit interrupter 20 for simultaneous movement. That is, the contact arms 48 are connected together through shaft 50 so they move in unison. The bridging assembly 45 is connected to the end of the elongated contact arm 48 opposite shaft 50. An insulating member 52 is provided at the end of contact arm 48 so that contact arm 48 is electrically insulated from the contact bridging assembly 45. A spring 55 is provided in contact assembly 45 to provide uniform contact pressure and proper seating of the bridging contact 46 on the stationary contacts 38 and 40. As can be seen from the drawings, when any one of the poles of the circuit interrupter 20 open, all the other poles must also open.

Through shaft 50 is rotatably supported by brackets 54 which are attached to the metallic base 30. Stationary contacts 38 and 40 are electrically insulated from base plate 30 by insulating sheet 56 which is secured to base plate 30. Terminal 36 is connected to insulating sheet 58 which is rigidly secured to base plate 30. Electrical conductor 42 is insulated from base plate 30 by insulating sheets 56 and 58 and transformer oil 19 which fills the open spaces in the circuit interrupter 20 during normal operation. Conductor 42, which is generally L-shaped, has its short leg portion attached to one leg of bimetal 44. The other leg of bimetal 44 attaches to L-shaped terminal 36.

A single operating mechanism 60 is provided for operating all poles of the circuit interrupter 20. Operator 60 is connected to one of the elongated contact arms 48 and as this contact arm 48 is moved, in response to the positioning of the operator 60, the other elongated contact arm 48, connected through shaft 50, also responds. The single operating mechanism 60 for all poles is mounted on side plates 62 and 64 which are securely attached to support base 30. The operating mechanism comprises a U-shaped operating member 66, the two legs of which are pivotally connected to side plates 62 and 64. Suitable latch means are provided to hold the circuit breaker 20 in the closed position thus forming the electrical circuit described above. Although a primary latch 72 and a secondary latch 92 are utilized in the preferred embodiment of their invention, other latch arrangements responsive to a trip mechanism may be utilized as well. Accordingly, a primary latch 72 is pivotally connected to a shaft 74 disposed between side plates 62 and 64. A pair of toggle links are provided with one end of the toggle connected to the elongated contact arm 48 and the other end of the toggle connected to primary latch 72 and having multiple springs 80 connected between the knee of the toggle and the top of U-shaped member 66 for raising contact arm 48 with a snap action when primary latch 72 is released. The toggle links are pivotally connected together by a knee pivot pin. The lower toggle member is connected at its lower end by a pivot pin to elongated contact arm 48. The upward force exerted by springs 80 holds the toggle links in engagement with primary latch 72. Primary latch 72 is releasably held in a latched position by secondary latch 92. Secondary latch 92 is biased toward an unlatched position by a torsion spring. When secondary latch 92 moves to the unlatched position, primary latch 72 is released and rotates due to the force of springs 80 collapsing the toggle which raises the elongated contact arm 48.

Secondary latch 92 is prevented from moving to the unlatched position when the breaker is closed by a cam surface 96 which is part of a trip bar mechanism 98. As can be seen with the circuit breaker normally closed, a portion of secondary latch 92 rests against the cam surface 96. When the trip bar mechanism is rotated a predetermined angle, the cam surface 96 passes through opening 100 in secondary latch 92 permitting secondary latch 92 to rotate to the unlatched position releasing primary latch 72 and tripping open the circuit breaker 20. Trip bar mechanism 98 is connected to be rotated by current responsive means when the current through the circuit breaker 20 exceeds a predetermined value.

Each pole of the circuit breaker 20 is provided with an individual trip device including a current responsive bimetal element 44, through which the load current of the associated pole passes. That is, the bimetal element 44 is electrically connected in the circuit of the circuit breaker 20 in series relation with the breaker contacts 38, 40 and 46. As seen in FIG. 5, the bimetal 44 is generally U-shaped with one leg connected to fixed conductor 42 and the other leg connected to fixed terminal 36. An extension or tab member 45, having first and second end portions 112 and 114 respectively, is joined to the upper portion of the bimetal element 44 by suitable means, such as by welding or riveting, and is deflectable therewith. The first or upper end 112 of the extension member is disposed in proximity with the trip bar mechanism 98 and includes an adjusting screw 102 threadably mounted adjacent the first end 112. Adjusting screw 102 is disposed so as to contact an insulating portion 104 of trip bar mechanism 98 when bimetal 44 deflects. Upon occurrence of, for example, an overload of less than 500% of normal rated current, the bimetal element 44 is heated and deflects toward the trip bar mechanism 98. As the bimetal element deflects due to flow of current therethrough, the first end of the extension member 45 deflects also and the rounded edge of adjusted screw 102 engages the insulating sheet 104 attached to trip bar mechanism 98, rotating the trip bar 98 counterclockwise to a tripped position which releases secondary latch 92. The cam portion 96 of trip bar mechanism 98 moves from under the latching surface to release the secondary latch 92. Primary latch 72 then rotates around pivot 74 moving the line of action of the springs 80 to the left of toggle pivot knee causing the toggle to collapse which opens the circuit breaker 20 with a snap action.

Operating member 66, which provides a connection for one end of springs 80, is mechanically linked to an operating handle 120 disposed on the transformer tank 11. Operating handle 120 is movable between an on position closing the circuit breaker 20 and an off position opening circuit breaker 20. The circuit breaker contacts 38, 40 and 46 are manually opened by clockwise movement of operating member 66, as operating handle 120 is moved to the off position. Clockwise movement of the operator 66 carries the line of action of the overcenter springs 80 to the right whereupon the force of springs 80 causes a collapse of the toggle, thereby moving the bridging contact 46 to the open position with a snap action. Contacts are closed by counterclockwise movement of the operator 66, as viewed in FIG. 3, which moves the line of action of the springs 80 across to the left. Consequently, the springs 80 actuate the toggle to its extended overcenter position, thereby moving the movable bridging contact 46 to the closed position with a snap action.

When the circuit interrupter 20 has tripped open, the primary latch 72 and the secondary latch 92 must be reset to a latched position before the circuit breaker can be closed. Relatching of the operating mechanism is effectuated by movement of the operator handle 120 beyond the off position. The circuit breaker 20 may then be closed by movement of the operating handle 120 to the one position causing the circuit breaker 20 to close in the previously described manner.

A magnetic trip means 108, which forms the novel part of this invention, is also provided to instantaneously trip the circuit breaker 20. According to the preferred embodiment of this invention, the bimetal actuating means is formed to become a part of the magnetic trip mechanism 108. As shown in FIG. 6, a portion of the extension or tab member 45 is joined to the upper portion of the bimetal element, such as at the joint 110 between the bimetal element 44 and the extension member 45. Each extension member, such as extension member 45, includes first and second end portions 112 and 114, respectively. The first or upper portion 112 of the extension member 45 has an adjustment screw 102 threadably mounted therethrough to engage the insulative portion 104 of the trip bar 98 upon deflection of the bimetal element 44. The second or lower end portion 114 of the extension member 45 is disposed adjacent one surface or side of the bimetal element 44 and includes a flange 116 extending outwardly from the edge of the second or lower portion 114 beyond the other side of the bimetal element 44. In the two-pole circuit breaker configuration depicted herein, the extension member associated with the second or other pole of the circuit breaker, such as extension member 45A shown in FIG. 6, includes an identical flange portion 116A. Thus, it can be seen that in a two-pole configuration, the extension members 45 and 45A are formed as mirror images of each other such that the respective flange portions 116 and 116A are situated adjacent the outermost edges of the aligned bimetal elements 44 and 44A. The flanges 116 and 116A include first and second slots or apertures 118 and 118A, respectively, which are co-axially aligned along a first axis 119 to form the hinge points for the magnetic trip means 108.

The magnetic trip means 108 includes an insulated member 120 which extends across all of the poles of the circuit breaker 20. For the two-pole circuit breaker illustrated herein, magnetic shunts 122 and 124, formed of highly-permeable magnetic material, are joined to one surface of the insulative member 120 by suitable means, such as rivets 123 for the magnetic shunt 122. The magnetic shunts 122 and 124 are L-shaped with mounting tabs or pins 126 and 128, respectively, extending outwardly from one end thereof. The mounting tabs 126 and 128 rotatably fit into the apertures 118 and 118A, respectively, of the flange portions 116 and 116A of the extension members 45 and 45A thereby forming a hinge which pivotally mounts the magnetic trip means 108 about the first axis 119. When the magnetic trip means 108 is mounted in the slots 118 and 118A of the flange portions of the extension members, the magnetic shunts 122 and 124 are disposed in proximity with the bimetal elements 44 and 44A, respectively, so as to be drawn thereto when a high overload current flows through the bimetal element. A trip arm 130 is securely joined to the insulative member 120 and includes a portion 131 extending therefrom which engages the trip bar mechanism 98 as described hereafter.

A tab or retainer member 132 is joined to the lower portion of the trip bar 98 and has an adjusting screw 134 threadably mounted therethrough. The first or upper portion 131 of the trip arm 130 is disposed in proximity with the adjustment screw 134 so as to engage the adjustment screw 134 and thereby rotate the tab member 132 and the trip bar 98 in a counterclockwise direction, as viewed in FIG. 3, when the lower portion of the magnetic trip means 108 is drawn towards the bimetal elements 44 or 44A.

When an overload current above a predetermined level flows through one of the bimetal elements 44 or 44A, the corresponding magnetic shunt 122 or 124 opposite the bimetal element through which the overload current is flowing will be drawn towards the bimetal element thus rotating the magnetic trip means 108 in a clockwise direction about the first axis 119. This rotation causes the upper portion 131 of the trip arm 130 to engage the adjustment screw 134 mounted on the tap 132 attached to the trip bar 98 and apply force thereto which causes the tab 132 and the trip bar 98 to rotate in a counterclockwise direction about its respective fixed axis releasing the secondary latch 92 and tripping open the circuit breaker 20.

For a three-pole circuit breaker, the continuous insulative member 120 of the magnetic trip means 108 would be lengthened to accommodate a third magnetic shunt which would be disposed in proximity with the bimetal element associated with the third pole of the circuit breaker. In such a configuration, the extension or tab member 45 associated with the middle bimetal element of the in-line poles would not have the above-described flange portions extending outwardly therefrom.

It will be apparent to one skilled in the art that there is herein disclosed a circuit breaker having a new magnetic trip mechanism. The magnetic trip means is pivotably mounted on hinge points formed in the extension member joined to the bimetal element. In response to a high overload current flowing through one of the bimetal elements, the lower portion of the magnetic trip means will be drawn towards the bimetal element thus rotating the magnetic trip means about its hinge points on the extension members. Rotation of the magnetic trip means causes the trip arm connected thereto to engage and apply force against a tab member attached to the trip bar mechanism which rotates the trip bar in a direction to release the latch and trip open the circuit breaker. Assembly of such a circuit breaker is simplified since the magnetic trip mechanism is slidably mounted in the hinge point without the need for additional hardware to secure it in position which provides a cost advantage.

We claim:

1. A circuit breaker comprising:

first and second separable electrical contacts;

means for moving at least one of said first and second electrical contacts between a closed position wherein said first and second electrical contacts are disposed in registry to complete an electrical circuit therethrough and an open position wherein said first and second electrical contacts are spaced apart;

latch means for latching said moving means in said closed position;

bimetal actuating means, responsive to current flow, for unlatching said latch means when current flow through said first and second electrical contacts exceeds a selected trip level for a predetermined period of time; and a magnetically-responsive trip pivotally mounted on said bimetal actuating means and having a first portion disposed in proximity to said bimetal actuating means to be drawn toward said bimetal actuating means when current flow through said bimetal actuating means exceeds a high current overload level and, also, having a second portion disposed in proximity with said latch means so as to unlatch said latch means when said first portion of said magnetically-responsive trip is drawn toward said bimetal actuating means.

2. The circuit breaker of claim 1 wherein the latch means comprises a trip bar supported for rotation about a fixed axis between a latched position and an unlatched position, said trip bar being rotated to said unlatched position by the bimetal actuating means when current flow through said bimetal actuating means exceeds a selected trip level for a predetermined period of time and, also, by the second portion of the magnetically-responsive trip when current flow through said bimetal actuating means exceeds a high current overload level.

3. The circuit breaker of claim 2 wherein the bimetal actuating means includes:

a bimetal element serially connected with the first and second electrical contacts for current flow therethrough; and an extension member connected to said bimetal element for unitary movement therewith, said extension member having a first portion disposed in proximity with the trip bar so as to rotate said trip bar to the unlatched position when current flow through said bimetal element exceeds a selected trip level, said extension member having a second portion disposed in proximity with one side of said bimetal element, said second portion having first and second flanges extending outwardly therefrom beyond the other side of said bimetal element, said first and second flanges having first and second apertures therein, respectively, which are coaxially aligned along a first axis to form hinge points wherein the magnetically-responsive trip is disposed for pivotal movement.

4. A circuit breaker comprising:

first and second electrical contact sets, each having first and second separable electrical contacts;

first and second means, associated, respectively, with said first and second contact sets, for moving at least one of said first and second contacts of each of said first and second contact sets between a closed position wherein said first and second contacts are in registry to complete an electrical circuit therethrough and an open position wherein said first and second contacts are spaced apart;

a shaft connecting said first and second moving means for unitary movement;

latch means, connected to one of said first and second moving means, for latching said first and second moving means in said closed position;

first and second bimetal actuating means respectively associated with said first and second contact sets and responsive to current flow, for unlatching said latch means when current flow through said respective first and second bimetal actuating means exceeds a selected trip level for a predetermined period of time; and a magnetically-responsive trip pivotally mounted on said first and second bimetal actuating means and having a first portion disposed in proximity with both of said bimetal actuating means to be drawn toward said first and second bimetal actuating means when current flow through either of said first and second bimetal actuating means exceeds a high current overload level and, also, having a second portion disposed in proximity with said latch means so as to unlatch said latch means when said first portion of said magnetically-responsive trip is drawn toward said first and second bimetal actuating means.

5. The circuit breaker of claim 4 wherein the first and second bimetal actuating means includes:

respective first and second bimetal elements serially connected with the first and second electrical contacts of the first and second contact sets for current flow therethrough, said first and second bimetal elements having first and second sides with edges therebetween, said first and second bimetal elements being disposed substantially in-line with said edges adjacent each other;

first and second extension members respectively connected to said first and second bimetal elements for unitary movement therewith;

said first and second extension members each having a first portion disposed in proximity with said latch means so as to unlatch said latch means when current flow through said first or second bimetal elements exceeds a selected trip level and causes said first or second bimetal elements to deflect;

each of said first and second extension members having a second portion disposed in proximity with one of said sides of said first and second bimetal elements, respectively, with first and second flanges, respectively, connected to the edges of said first and second extension members opposite said edges disposed adjacent each other, said first and second flanges extending outwardly from said first and second extension members, respectively, beyond the other side of said first and second bimetal elements, said first and second flanges having first and second apertures therein, respectively, which are coaxially aligned along a first axis to provide hinge points in which the magnetically-responsive trip is pivotally mounted.

6. The circuit breaker of claim 5 wherein the latch means includes:

primary latch means connected to one of the first and second moving means and having a latched position latching said one of said first and second moving means and an unlatched position releasing said one of said first and second moving means;

secondary latch means movable between a first position latching said primary latch in said latched position and a second position releasing said primary latch;

a retainer supported for rotary movement about a fixed shaft between a first position latching said secondary latch and a second position releasing said secondary latch; and a trip bar secured to said fixed shaft for causing rotation thereof, said trip bar having first and second portions, said first portion of said trip bar being disposed in proximity with the first portions of the first and second extension members so as to be rotated thereby when current flow through the first or second bimetal elements exceeds a selected trip level for a predetermined period of time, said second portion of said trip bar being disposed in proximity to the second end of the magnetically-responsive trip so as to be rotated thereby when said magnetically-responsive trip rotates about the first axis in response to a high overload current flowing through said first or second bimetal elements.

7. The circuit breaker of claim 5 wherein the magnetically-responsive trip includes:

an insulative member disposed in proximity with both of the first and second bimetal elements;

first and second magnetizable members having first and second pins connected thereto, respectively, said first and second pins being rotatably disposed in the first and second apertures in the first and second extension members, respectively, said first and second magnetizable members being connected to said insulative member and positioned so as to be drawn toward said, respective, first and second bimetal elements when current flow through said first or second bimetal elements exceeds a high current overload level, thereby rotating said insulative member about said first axis; and a trip arm having one end secured to said insulative member and another end disposed in proximity with said latch means so as to unlatch said latch means upon rotation of said insulative member when current flow to either of said first or second bimetal elements exceeds a high current overload level.

* * * * *